United States Patent [19]

Yamamoto et al.

[11] 4,081,385

[45] Mar. 28, 1978

[54] 4-VINYLPYRIDINE POLYMETHACRYLATE CONTAINING LUBE OIL COMPOSITIONS

[75] Inventors: Roy I. Yamamoto, Wappingers Falls; Carmen M. Cusano; Frank J. Gaetani, both of Poughkeepsie, all of N.Y.

[73] Assignee: Texaco Inc., New York, N.Y.

[21] Appl. No.: 737,935

[22] Filed: Nov. 2, 1976

[51] Int. Cl.[2] ..... C10M 1/48; C10M 3/42; C10M 5/24; C10M 7/46

[52] U.S. Cl. ..... 252/32.7 E; 252/33; 252/33.6; 252/42.7; 252/51.5 A

[58] Field of Search ..... 252/32.7 E, 51.5 A, 252/33, 33.6, 42.7

[56] References Cited

U.S. PATENT DOCUMENTS

| | | | |
|---|---|---|---|
| 2,839,512 | 6/1958 | Barnum et al. | 252/51.5 A |
| 3,438,897 | 4/1969 | Henderson | 252/32.7 E |
| 3,892,671 | 7/1975 | Song et al. | 252/51.5 A |
| 4,021,357 | 5/1977 | Morduchowitz et al. | 252/51.5 A |

*Primary Examiner*—Delbert E. Gantz
*Assistant Examiner*—Irving Vaughn
*Attorney, Agent, or Firm*—Thomas H. Whaley; Carl G. Ries; Robert A. Kulason

[57] ABSTRACT

A fully formulated crankcase lubricating oil composition containing between about 0.1 and 10 wt. % of a tetrapolymer of 4-vinylpyridine (4-VP), a first alkyl methacrylate of the formula:

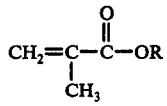

a second alkyl methacrylate of the formula:

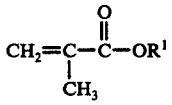

and a third alkyl methacrylate of the formula:

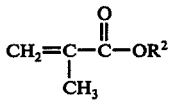

where R is alkyl of from 1 to 6 carbons, $R^1$ is alkyl of from 10 to 15 carbons and $R^2$ is alkyl of from 16 to 20 carbons, of a molecular weight between about 25,000 and 2,500,000 having a component ratio of 4-VP:$C_1$ to $C_6$ alkyl methacrylate:$C_{10}$–$C_{15}$ alkyl methacrylate:$C_{16}$–$C_{20}$ alkyl methacrylate of between about 2:10:78:10 and 10:30:30:30 and between about 0.1 and 5 wt. % of a calcium containing rust inhibitor, said composition having a sulfated metal ash content of between about 0.05 and 1 wt. %.

5 Claims, No Drawings

4-VINYLPYRIDINE POLYMETHACRYLATE CONTAINING LUBE OIL COMPOSITIONS

BACKGROUND OF INVENTION

The introduction of catalytic mufflers precipitated considerable concern that the catalyst in these anti-pollution devices could be poisoned by metals from fuels and lubricant additives. With regard to crankcase oils for combustion engines, attention has been focused on eliminating or at least reducing the metal content in the additive package used therein in an effort to obviate the crankcase oils as a source of catalytic muffler poisoning. It is the general consensus that if the metal content in lubricating oils attributable to additives can be maintained below about 1 wt. % (sulfated ash basis) such low ash lubricating oils are compatible with today's pollution technology. In addition, low ash oils provide performance advantages in reducing spark plug fouling contributing less to higher octane requirements of gasoline than high ash formulations (substantially above 1 wt. % sulfated ash). The principal candidates as a combination dispersant-VI improver in low ash formulations are the polyalkylmethacrylates of a molecular weight between about 25,000 and 2,500,000. However, it was found that at the low sulfated ash levels (0.05–1 wt. %) the standard polyalkylmethacrylate dispersants such as the tetrapolymer of dialkylaminoalkylmethacrylate, $C_1$–$C_6$ methacrylate, $C_{10}$–$C_{15}$ alkyl methacrylate and $C_{16}$–$C_{20}$ alkyl methacrylate while generally providing excellent dispersant activity undesirably degraded rust protection of the low ash crankcase oils. This tendency to degrade is masked in the high ash content oils in that the calcium rust inhibitor compounds therein compensate for the deteriorating effect of the polymethacrylates, this excess not being present in the low ash oils. Accordingly, there was need in respect to the low ash oils to develop an ashless dispersant-VI improver which did not degrade the rust protection of the crankcase oil formulation of which it is a part.

The terms "fully formulated" and "finished" employed hereinbefore and hereinafter denotes a crankcase oil which contains as a minimum, additive(s) which supply(s) anti-rust, anti-corrosion (non ferrous), and dispersancy properties to the oil formulation. The fully formulated compositions usually contain, but not necessarily, additional additives such as supplementary dispersant, anti-oxidant, anti-wear agent and anti-foamants. It is to be noted a single additive may have multiple properties such as anti-rust, corrosion inhibition and dispersancy and thus a crankcase oil containing only such an additive would be deemed "fully formulated" or "finished." Further, when referring to ash, it is intended to denote the amount of inorganic ash in oil formulations left after combustion and treatment with sulfuric acid. Still further, the term "anti-rust" refers to ferrous metal protection and the terms "corrosion inhibition" or "corrosion inhibitor" refers to protection of non ferrous metals.

SUMMARY OF INVENTION

We have discovered and this constitutes our invention novel fully formulated, low ash, crankcase lubricating oil compositions of improved dispersancy and antirust properties containing between about 0.1 and 10 wt. % of an interpolymer of 4-vinylpyridine (4-VP), $C_1$–$C_6$ alkyl methacrylate, $C_{10}$–$C_{15}$ alkyl methacrylate and $C_{16}$–$C_{20}$ alkyl methacrylate of a molecular weight between about 25,000 and 2,500,000 having a respective monomer weight ratio of between about 2:10:78:10 and 10:30:30:30 and between about 0.1 and 5 wt. % calcium containing rust inhibitor, said composition rendering a sulfated ash content of between about 0.05 and 1 wt. %. More specifically, it has been discovered when said interpolymer is incorporated in said composition, it provides not only a superior dispersancy and VI improvement but does not degrade the rust protection of the crankcase formulation afforded by the standard calcium containing rust inhibiting additives for crankcase oils.

DETAILED DESCRIPTION OF THE INVENTION

More specifically, the novel crankcase formulations contemplated herein comprise between about 80 and 95 wt. % mineral lubricating oil, between about 0.1 and 10 wt. %, preferably between about 1.0 and 5.0 wt. %, of the 4-VP containing polymethacrylates, between about 0.1 and 5 wt. % of a rust inhibitor, between about 0.1 and 5 wt. % of a corrosion inhibitor and optionally including additional additives such as the aforementioned supplementary dispersants, antiwear agents, antioxidants, antifoamants and the like to form the remainder (e.g. from 0 to about 10 wt. %) of the fully formulated composition.

The non antirust degrading interpolymeric polymethacrylate dispersant contemplated in the novel compositions of the invention is a tetrapolymer consisting of 4-vinylpyridine, a first alkyl methacrylate of the formula:

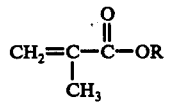

a second alkyl methacrylate of the formula:

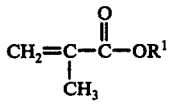

and a third alkyl methacrylate of the formula:

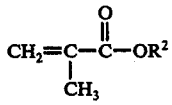

where R is alkyl of from 1 to 6 carbons, $R^1$ is alkyl of from 10 to 15 carbons and $R^2$ is alkyl of from 16 to 20 carbons having a molecular weight of between about 25,000 and 2,500,000, preferably between 100,000 and 1,000,000, an intrinsic viscosity in benzene at 77° F. of between about 0.2 and 1.8, preferably between 0.5 and 1.5, and a component weight ratio of 4-vinylpyridine to said first alkyl methacrylate to said second alkyl methacrylate to said third alkyl methacrylate of between about 2:10:78:10 and 10:30:30:30, preferably between about 3:15:67:15 and 6:25:44:25.

The tetrapolymer contemplated herein is prepared by contacting a mixture of 4-vinylpyridine and first, second and third alkyl methacrylate monomers in the presence of a standard polymerization catalyst and transfer agent in an inert atmosphere, preferably in the presence of a diluent such as between about 20 and 60 wt. % hydrocarbon oil. The reaction is advantageously conducted under conditions of agitation and at a temperature of between about 50° and 100° C. Under the preferred conditions, the monomers, transfer agent and a portion of the hydrocarbon oil diluent are first charged to the reactor and when the desired reaction temperature is obtained the polymerization catalyst added. Most advantageously, the catalyst is added in some two to five additions with additional diluent oil may be added during the second or later dose of polymerization catalyst, normally in the amount of between about 0 and 250 wt. % of the reaction mixture. Polymerization is continued until all the monomers are essentially consumed, this latter occurrence is signified by the refractive index remaining constant. In each addition there is generally utilized between about 0.05 and 0.4 wt. % of standard polymerization catalyst basis the reaction mixture. Examples of the polymerization catalysts contemplated herein are azobisisobutyronitrile and other organic azo compounds. A specific example of a contemplated transfer agent is lauryl mercaptan. It is to be noted that the quantities of individual monomeric methacrylate and vinylpyridine components charged to the reactor should be generally equal to the component ratios desired in the final interpolymer product.

In the preparation of the aforedescribed interpolymer, specific examples of the $C_1$–$C_6$ alkyl methacrylate monomers are methyl methacrylate, butyl methacrylate, hexyl methacrylate and mixtures thereof. Examples of the $C_{10}$–$C_{15}$ alkyl methacrylate monomers are decylmethacrylate, undecylmethacrylate, dodecylmethacrylate, tridecylmethacrylate, tetradecylmethacrylate and mixtures of alkyl methacrylates falling essentially within the defined alkyl carbon range. Specific examples of the $C_{16}$–$C_{20}$ alkyl methacrylate monomers contemplated herein are hexyldecylmethacrylate, heptadecylmethacrylate, octadecylmethacrylate, nonadecylmethacrylate, eicosylmethacrylate and mixtures thereof.

In respect to the above, mixtures of alkyl methacrylate monomers are normally found when commercial alcohols are employed in the monomer manufacture since many commercial alcohols are actually a mixture of adjacent and closely adjacent homologs with one or two particular carbon chain lengths predominating.

The mineral hydrocarbon oils of lubricating viscosity contemplated for use in the preparation of the 4-VP terpolymer as well as the base oil in the lubricating oil compositions contemplated herein can be derived from a wide variety of sources such as naphthenic base, paraffinic base and mixed base mineral oils, e.g., having an SUS viscosity at 100° F. of between about 35 and 1000.

Examples of contemplated rust inhibitors are the overbased calcium sulfonates, for example, calcium carbonate overbased sulfonate of a total base number between about 100 and 500 and a molecular weight between about 500 and 1300. A specific examples of such a sulfonate is found in U.S. Pat. No. 3,537,996. Still another class of contemplated rust inhibitors are calcium alkylphenolates where the alkyl group attached to the phenol has between about 5 and 50 carbons. One specific example is calcium $C_{10}$–$C_{12}$ alkylphenolates.

Examples of the Group II metal additives which function as standard corrosion inhibitors for non ferrous metals are the zinc dihydrocarbyl dithiophosphates and zinc dihydrocarbyloxy dithiophosphates such as zinc dinonylphenoxyethyl dithiophosphate, zinc didodecylphenoxyethyl dithiophosphate, zinc dinonylphenyl dithiophosphate and zinc dihexyldithiophosphate. The materials also exhibit antioxidant and antiwear properties. Other examples are zinc dialkyldithiocarbamate, e.g., zinc diamyldithiocarbamate. The corrosion inhibitors used in the finished formulations contemplated herein are found in amounts of between about 0.1 and 5 wt. %.

Examples of the optional standard supplementary dispersants contemplated are the alkenyl succinimides of polyalkylene polyamines, for example, those characterized by the general formula:

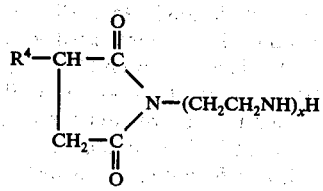

where $R^4$ is a large substantially monoolefinic aliphatic hydrocarbon radical of from 50 to 200 carbon atoms and $x$ is an integer of from 1 to 10. Particularly suitable derivatives are the diethylenetetramine, tetraethylenepentamine of polyisobutylene succinic anhydride where $R^4$ is between about 700 and 2000, e.g., 1300 molecular weight. These supplementary dispersants are further described in U.S. Pat. Nos. 3,172,892 and 3,202,678. The supplementary dispersants when employed are present in the finished formulations in an amount of between about 3.0 and 8.0 wt. %.

Examples of the optional standard antioxidants contemplated are the aryl substituted amines such as ethyl substituted mono- and dinonylphenylamine, phenylnaphthylamine, phenylenediamine, phenothiazine, diphenylamine and the bis-alkyldithiothiadiazole such as 2,5-bis-octyldithiothiadiazole. Antioxidants when present in the finished formulations are advantageously present in amounts of between about 0.1 and 5 wt. %.

Examples of the antifoamant agents which are conventionally employed in the finished lubricating oil compositions are the silicone fluids of high viscosity such as dimethyl silicone polymer having a kinematic viscosity at 25° C. of between about 1000 and 100,000. The antifoamants when employed are present in amounts of between about 5 and 50 ppm.

The following examples further illustrate compositions of the invention but are not to be construed as limitations thereof.

EXAMPLE I

This example illustrates the preparation of the 4-vinylpyridine polymethacrylate terpolymer composition component contemplated herein.

To a 1-liter resin kettle equipped with a nitrogen inlet tube, stirrer, heater, cooling fan, thermister and thermocouple, the following materials were charged:

| Materials | Grams | Moles |
|---|---|---|
| 4-vinylpyridine (4-VP) | 40 | 0.38 |
| Butylmethacrylate (BMA) | 210 | 1.48 |
| Neodol 25L* Methacrylate (NMA) | 500 | 1.79 |
| Alfol 1620 SP** Methacrylate (AMA) | 250 | 0.77 |
| 1-Dodecanethiol | 0.25 | 0.001 |
| Mineral Oil A (~145 SUS at 100° F.) | 500 | — |

After purging the charged vessel with prepurified nitrogen for about a 15 minute period with stirring, the reaction mixture was heated to 83° C. Stirring was conducted during the entire reaction period. When a temperature of 83° C. was reached, the initiator azobisisobutyronitrile (AIBN) was added in an amount of 2 grams on a neat basis. Samples were taken at intervals and the refractive index determined at 54° C. ($N_D^{54°C}$). When the $N_D^{54°C}$ became constant an additional 0.75 gram of AIBN and 940 grams of mineral oil (~100 SUS at 100° F.) were added. After 1 hour a third dosage of 0.75 gram of AIBN was added. After an additional hour the temperature was raised to 100° C. for an hour and the formed terpolymer concentrate was allowed to cool and used for preparing blends. The product formed was characterized as a 41 wt. % lube oil solution of a 4:21:50:25 weight ratio 4-VP:BMA:NMA:AMA polymethacrylate polymer in mineral oil.

The NMA and AMA monomers described above are respectively derived from Neodol 25L* and Alfol 1620 SP** which are tradenames for technical grade alcohols respectively of Shell Chemical Company and Continental Oil Co. having the following typical analysis:

| | Typical Approx. Homolog Distribution, wt. % |
|---|---|
| Neodol 25L* (Synthetic Lauryl Alcohol) | |
| Lighter than $C_{12}OH$ | 4 |
| $C_{12}OH$ | 24 |
| $C_{13}OH$ | 24 |
| $C_{14}OH$ | 24 |
| $C_{15}OH$ | 15 |
| $C_{16}OH$ | 2 |
| Alfol 1620** (Synthetic Stearyl Alcohol) | |
| $C_{14}OH$ and lighter | 4 |
| $C_{16}OH$ | 55 |
| $C_{18}OH$ | 28 |
| $C_{20}OH$ | 9 |

The resultant alkyl methacrylate monomers derived from the reaction of methacrylic acid with the above alcohols are in essence a mixture of $C_{12}$ to $C_{16}$ alkyl methacrylates for those derived from Neodol 25L* and $C_{16}$ to $C_{20}$ alkyl methacrylates for those derived from Alfol 1620 SP** with the same weight percent distribution for a specific alkyl methacrylate as is found in the alcohol mixture. This same weight distribution of the $C_{12}$ to $C_{16}$ and $C_{16}$ to $C_{20}$ methacrylate will also carry over into the interpolymer.

EXAMPLE II

This example illustrates the 4-vinylpyridine terpolymer containing lubricating oil compositions and the unexpected effectiveness of the contemplated 4-vinylpyridine in providing superior dispersancy to the formulation containing same without degrading the rust protection of the formulations below the critical standard specification requirements of the auto industry.

Seven fully formulated crankcase lubricating oil compositions were tested for rust protection in the Oldsmobile Sequence IIC Rust Test and for dispersancy in the Ford Sequence VC Test both described in ASTM publication STP 315 F, "Multicylindered Test Sequence for Evaluating Automotive Engine Oils" Jan. 1973. For a given test the seven formulations employed were identical with the exception that the nitrogen containing component in the polymethacrylate ingredient was varied. Specifically, the representative polymethacrylate formulation employed is the 41 wt. % lube oil formulation prepared and described in Example I. In the comparative formulations the terpolymer solutions were identical to the Example I formulation with the exception that the following monomer components were substituted for 4-vinylpyridine: 2-vinylpyridine; 2-methyl-5-vinylpyridine; dimethylaminoethyl methacrylate; diethylaminoethyl methacrylate; dimethylaminopropylmethacrylamide; and N-vinylpyrrolidone. The generic blends tested in the Oldsmobile Sequence IIC Rust Test and the Ford Sequence VC Test are as follows:

TABLE I

| Generic Formulation (Blend) | | |
|---|---|---|
| Ingredients | Blend A, Wt.% | Blend B, Wt.% |
| Mineral Oil (~200 SUS at 100° F.) | 89.10 | 89.65 |
| Zinc ($C_3$–$C_8$ dialkyl dithiophosphate) | 0.65 | 1.35 |
| $CaCO_3$ overbased Ca Sulfonate (~300 TBN) | 1.00* | 2.00* |
| Polyisobutylene (~1200 m.w.) succinimide of tetraethylene pentamine | — | 2.15 |
| Ethyl substituted Mono- and Dinonylphenylamine | 0.25 | — |
| Poly (Dimethyl Silicone) | — | 150 ppm |
| Polymethacrylate | 9.00** | 4.85** |

*45 wt. % lube oil solution
**41 wt. % lube oil solution

Blend A gave a sulfated ash of 0.5 wt. % and Blend B a sulfurized ash of 1 wt. %. Evaluation of the generic lubricating oil compositions of Table I in which the ingredients are varied are reported in Table II below:

TABLE II

EVALUATION OF SPECIFIC CRANKCASE FORMULATIONS

| Nitrogen Component In Polymethacrylate Of Blends A and B | Oldsmobile Seq. IIC Average Rust Rating[1] on Blend A | Ford Seq. VC Sludge Rating[2] on Blend B |
|---|---|---|
| 4-Vinylpyridine | 8.5 | 9.4 |
| 2-Vinylpyridine | 8.6 | 5.4 |
| 2-Methyl-5-Vinylpyridine | 7.7 | — |
| Dimethylaminoethyl Methacrylate | 5.9 | 9.0 |
| Diethylaminoethyl Methacrylate | 5.1 | — |
| Dimethylaminopropyl Methacrylamide | 5.3 | — |
| N-Vinyl-Pyrrolidone | 8.3 | 4.9 |

[1]8.4 minimum rating for a pass; 0.5% ash formulation.
[2]8.5 minimum rating for a pass; 1.0% ash formulation.

As can be seen from above, only the representative 4-vinylpyridine terpolymer polymethacrylate containing formulation meets the specification of both the Oldsmobile Sequence IIC Rust Test and the Ford Sequence VC Dispersant Test whereas the comparative polymethacrylates either degrade the formulation to a point of unacceptability in respect to antirust properties and/or do not have sufficient dispersant properties to meet the critical test requirements.

We claim:

1. A fully formulated crankcase lubricating oil formulation rendering a sulfated ash content of between about 0.05 and 1 wt. % comprising between about 85 and 95 wt. % mineral lubricating oil, between about 0.1 and 10 wt. % of a tetrapolymer of 4-vinylpyridine, a first alkyl methacrylate of the formula:

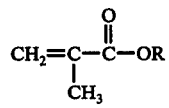

a second alkyl methacrylate of the formula:

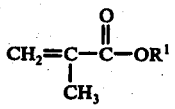

and a third alkyl methacrylate of the formula:

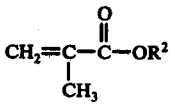

where R is alkyl of from 1 to 6 carbons, $R^1$ is alkyl of from 10 to 15 carbons and $R^2$ is alkyl of from 16 to 20 carbons of a molecular weight between about 25,000 and 2,500,000 having a component ratio of 4-VP:$C_1$–$C_6$ alkylmethacrylate:$C_{10}$–$C_{15}$ alkyl methacrylate:$C_{16}$–$C_{20}$ alkyl methacrylate of between about 2:10:78:10 and 10:30:30:30 and between about 0.1 and 5 wt. % of a calcium containing rust inhibitor for crankcase oils.

2. A fully formulated crankcase lubricating oil formulation rendering a sulfated ash content between about 0.05 and 1 wt. % comprising between about 85 and 95 wt. % mineral lubricating oil of between about 0.1 and 10 wt. % of a tetrapolymer of 4-vinylpyridine, a first alkyl methacrylate of the formula:

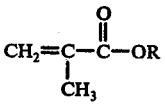

a second alkyl methacrylate of the formula:

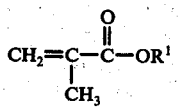

and a third alkyl methacrylate of the formula:

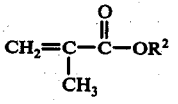

where R is alkyl of from 1 to 6 carbons, $R^1$ is alkyl of from 10 to 15 carbons and $R^2$ is alkyl of from 16 to 20 carbons of a molecular weight between about 25,000 and 2,500,000 having a component ratio of 4-VP:$C_1$–$C_6$ alkylmethacrylate:$C_{10}$–$C_{15}$ alkyl methacrylate:$C_{16}$–$C_{20}$ alkyl methacrylate of between about 2:10:78:10 and 10:30:30:30, between about 0.1 and 5 wt. % of a calcium containing rust inhibitor for crankcase oils and between about 0.1 and 5 wt. % of a zinc containing corrosion inhibitor for crankcase oils.

3. A fully formulated crankcase oil composition in accordance with claim 2 wherein said corrosion inhibitor is selected from the group consisting of zinc dihydrocarbyloxy dithiophosphate, zinc dihydrocarbyl dithiophosphate, zinc dialkyl dithiocarbamate and mixtures thereof and said rust inhibitor is selected from the group consisting of overbased calcium hydrocarbyl sulfonate and calcium alkylphenolate.

4. A fully formulated crankcase oil composition in accordance with claim 2 wherein said corrosion inhibitor is zinc dialkyl dithiophosphate and said rust inhibitor is overbased calcium hydrocarbyl sulfonate.

5. A fully formulated crankcase oil composition in accordance with claim 2 wherein said component ratio is about 4:21:50:25, said molecular weight is between about 100,000 and 1,000,000 and said corrosion inhibitor is zinc di-($C_3$–$C_8$ alkyl) dithiophosphate and said rust inhibitor is overbased calcium alkaryl sulfonate of a molecular weight of between about 500 and 2000 and a Total Base Number of between about 200 and 500.

* * * * *